US008425275B2

(12) United States Patent
Noel

(10) Patent No.: US 8,425,275 B2
(45) Date of Patent: Apr. 23, 2013

(54) BODY GARMENT AND SHAPEWEAR DESIGN AND METHOD OF USE

(76) Inventor: Kelle Noel, Scottsdale, AZ (US)

( * ) Notice: Subject to any disclaimer, the term of this patent is extended or adjusted under 35 U.S.C. 154(b) by 782 days.

(21) Appl. No.: 12/569,679

(22) Filed: Sep. 29, 2009

(65) Prior Publication Data

US 2010/0099332 A1 Apr. 22, 2010

Related U.S. Application Data

(60) Provisional application No. 61/101,065, filed on Sep. 29, 2008.

(51) Int. Cl.
*A41C 1/00* (2006.01)

(52) U.S. Cl.
USPC ..... 450/96; 450/131; 2/408

(58) Field of Classification Search ..... 450/7, 8, 450/11, 95, 96, 105–107, 113, 115–118, 450/151, 20, 21, 130, 131, 122–124; 2/115, 2/246, 244, 105, 106, 113, 69, 67, 243.1, 2/408; 66/170, 171, 175, 176, 177
See application file for complete search history.

(56) References Cited

U.S. PATENT DOCUMENTS

| | | | | |
|---|---|---|---|---|
| 2,476,585 | A * | 7/1949 | Cohen | 450/105 |
| 2,522,009 | A * | 9/1950 | Wohlman | 450/105 |
| 3,224,448 | A * | 12/1965 | Diebold | 450/105 |
| 3,712,308 | A * | 1/1973 | Herbener | 450/95 |
| 3,823,721 | A * | 7/1974 | Herbener | 450/100 |
| 5,566,392 | A * | 10/1996 | Dzelzkalns | 2/73 |
| 5,605,060 | A * | 2/1997 | Osborne | 66/171 |
| 5,699,559 | A * | 12/1997 | Sano | 2/67 |
| 5,762,535 | A * | 6/1998 | Nishiyama et al. | 450/98 |
| 5,996,120 | A * | 12/1999 | Balit | 2/67 |
| 6,526,589 | B1 * | 3/2003 | Jeziak et al. | 2/69 |
| 7,318,240 | B1 | 1/2008 | Rendone | |
| 2003/0110551 | A1 | 6/2003 | Lazarian | |

FOREIGN PATENT DOCUMENTS

| | | |
|---|---|---|
| DE | 297 06 032 U | 12/1997 |
| WO | 00/65940 A1 | 11/2000 |

* cited by examiner

*Primary Examiner* — Gloria Hale
(74) *Attorney, Agent, or Firm* — Sandra P. Thompson; Buchalter Nemer

(57) ABSTRACT

A shapewear garment is described that includes a one-piece foundation, wherein the foundation comprises a compression material having at least one area of firm support and at least one area of light support; and at least one resealable thong-like seam.

18 Claims, 4 Drawing Sheets

FIG. 1
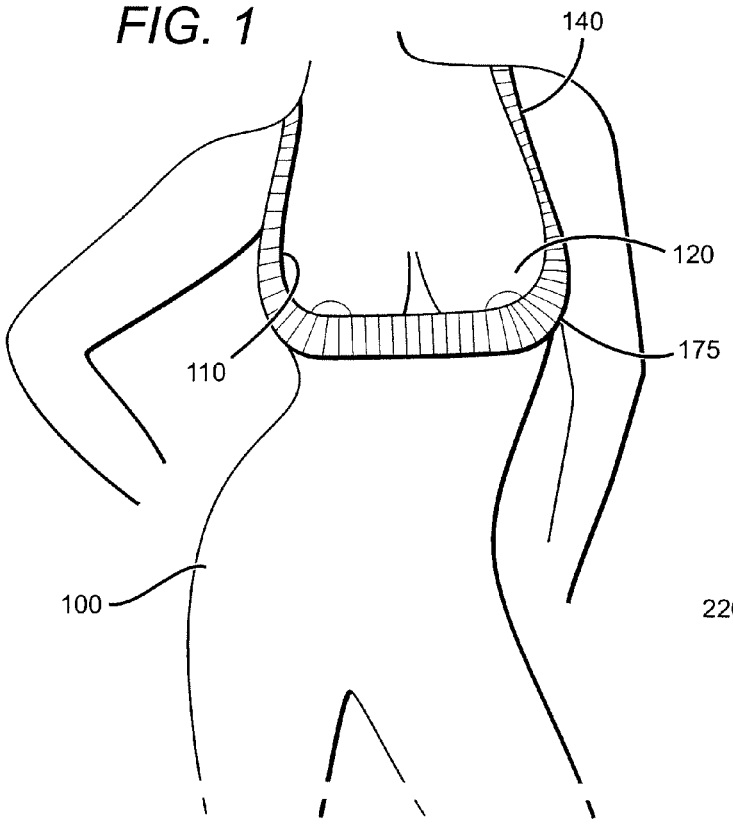
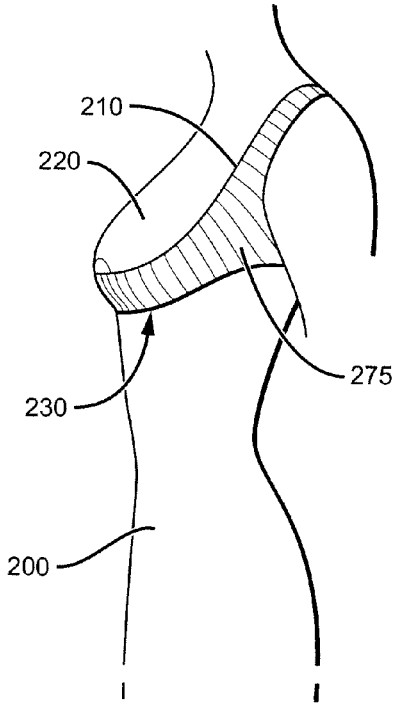
FIG. 2
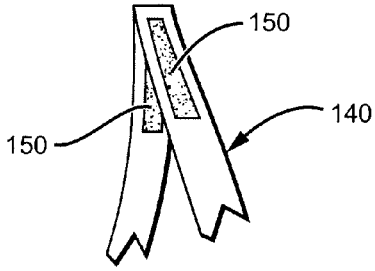
FIG. 1A

FIG. 3
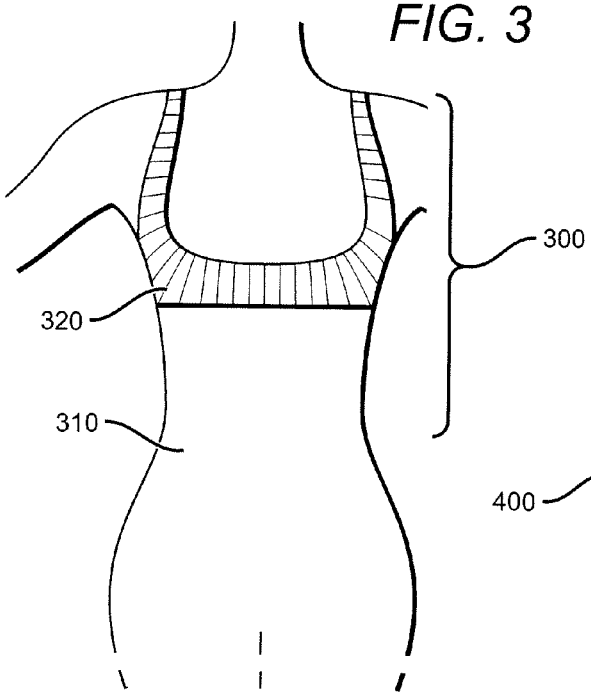
FIG. 4
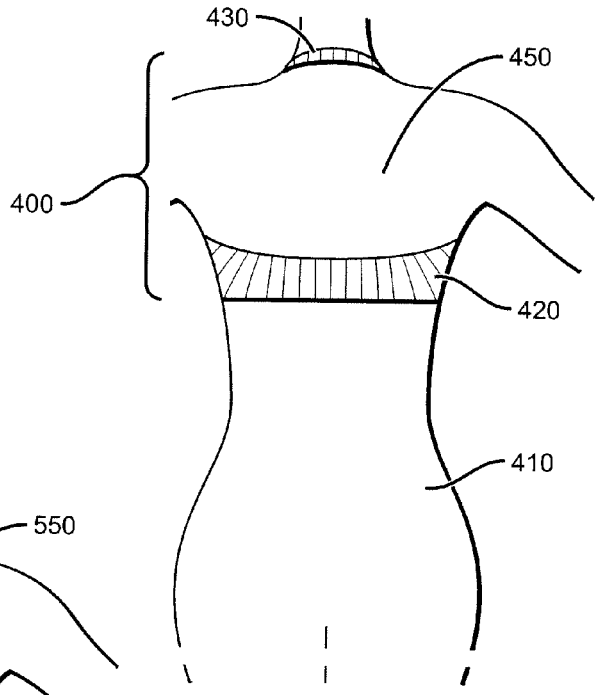
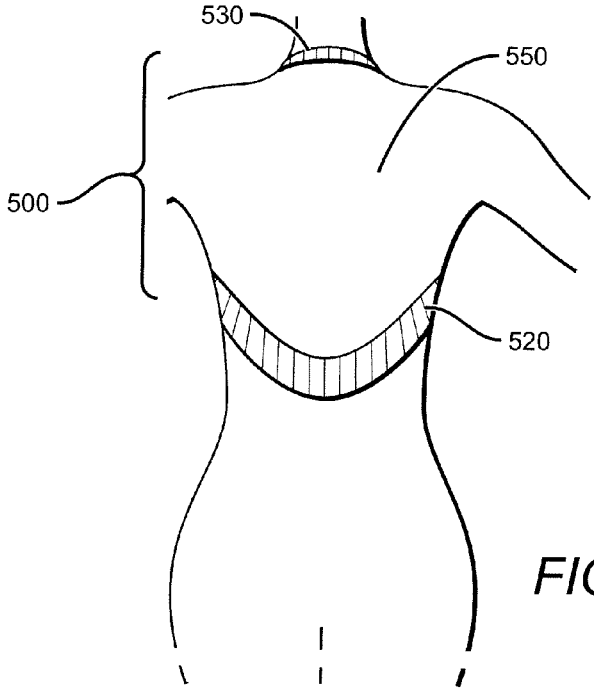
FIG. 5

BODY GARMENT AND SHAPEWEAR DESIGN AND METHOD OF USE

This utility application claims priority to U.S. Provisional Application Ser. No. 61/101,065 filed on Sep. 29, 2008, which is incorporated herein in its entirety by reference.

BACKGROUND

There are a number of undergarments and bodysuits that are designed to provide a smooth appearance under clothing, provide support for breasts and buttocks, and provide "control" of shapely features. U.S. Pat. No. 7,318,240 describes, for example, a one-piece undergarment bodysuit that has two sets of straps running vertically along the body where removable panels can be placed along the body, or removed to provide access to various parts of the body—both depending on the needs of the wearer. This type of undergarment is preferably designed to be incorporated into lingerie.

There is a need in the clothing and undergarment industry for a one-piece bodysuit and undergarment that provides a seamless, over-all toned appearance to every body type, while providing the flexibility for the wearer to utilize additional supporting garments, such as a bra, and also providing the wearer the opportunity go to the bathroom without soiling the bodysuit and/or removing the entire garment.

SUMMARY

A shapewear garment is described that includes a one-piece foundation, wherein the foundation comprises a compression material having at least one area of firm support and at least one area of light support, and at least one resealable thong-like seam.

BRIEF DESCRIPTION OF THE FIGURES

FIG. 1 shows a contemplated embodiment.
FIG. 1A shows a contemplated embodiment of a strap.
FIG. 2 shows a contemplated embodiment.
FIG. 3 shows a contemplated embodiment.
FIG. 4 shows a contemplated embodiment.
FIG. 5 shows a contemplated embodiment.

DETAILED DESCRIPTION

Figure 6:
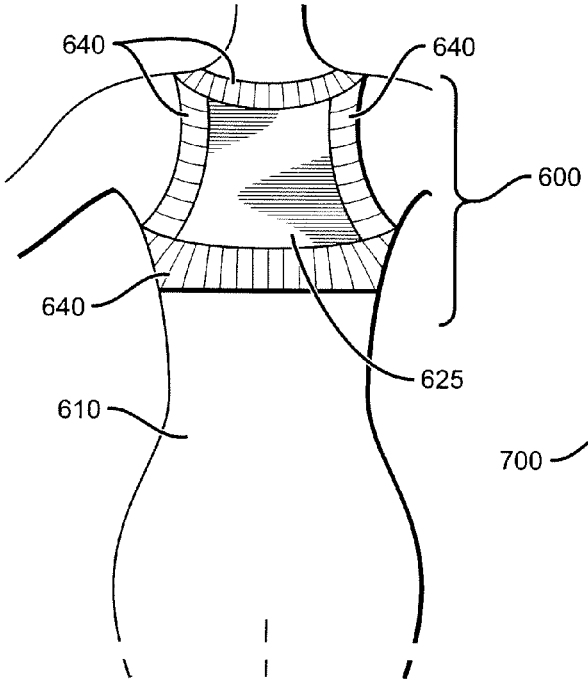
FIG. 6 shows a contemplated embodiment.

A shapewear garment has been designed and is described herein that meets all of the design goals previously described. Contemplated designs and specific embodiments are described herein and shown in the Figures. This design sets this garment apart from the others, including Donna Karan's Cat Suit, Lipo in a Box Firm Control Capri Bodysuit and the Spanx Hide and Sleek Full Bodysuit.

A shapewear garment is described that includes a one-piece foundation, wherein the foundation comprises a compression material having at least one area of firm support and at least one area of light support, and at least one resealable thong-like seam. In contemplated embodiments, the one-piece foundation is designed to be different from conventional shapewear in that it provides a sleek look for the wearer from top to bottom without unsightly body bulges that appear at the meeting points of other multi-piece shapewear garments.

In contemplated embodiments, shapewear garments comprise sleek nylon SPANDEX® threads that allow the garments to be worn under a multitude of clothing styles and fabrics. Contemplated garments are intended to fit like a second skin, serving as a foundation that can be easily worn under other high compression body slimmers for those who desire an even tighter appearance.

In one embodiment, the weave of the garment is compressed such that it transitions gradually from gentle or light support to concentrated or firm support in harmony with the natural contours of the body to provide control and support where needed without pinching the skin or abruptly ending causing skin to bulge over the garments edge. The gentle transitioning compression design concept, which is called a "transitional weave", ideally mimics the body's muscle pattern; however, it is contemplated that this transitional weave would mimic the body's muscle example or outline if the circular knit machine or equipment could not accommodate the ideal muscle pattern. Additionally, the transitional weave is fundamental to the garments' toning function and resulting natural appearance.

As shown in FIGS. 1 and 2, shapewear garments comprise a strapped one-piece foundation 100 and 200 that is cut in front 110 and 210 below the breast 120 and 220 with a gentle support shelf bra 230 for lift, shown in FIG. 2. The firmer back is cut just below the shoulder blades.

In some contemplated embodiments, the gentle support shelf bra 230 may be replaced by a textured strip or area that provides grippability of the shapewear garment seam to a bra, if a bra is being worn. It should be understood that this textured, rubberized or shelf bra area is designed to couple with a bra or provide enough breast support to the wearer, so as to give a seamless appearance between the breast area and the abdomen area. All of these features allow the wearer the option to wear this garment with or without their favorite bra. The tighter compression around the midriff, waist and lower abdomen give a firm foundation for outer garment waistbands, minimizing unsightly bulges over waist tops of pants and skirts. The firmer lower back and upper thigh give lift to the gently compressed derriere to give it a natural appearance. In lieu of a gusset, a two-piece rolled thong-like seam, a two-piece thong-like elasticized seam or a combination thereof further defines the natural lines of the derriere.

Contemplated body garments may comprise straps 140 that are knitted with a gentle yet supportive weave, as shown in FIG. 1A. Contemplated straps are thin to prevent bulk and wide to prevent cutting into shoulders. Contemplated straps are positioned with an inward design to prevent being seen when worn under a sleeveless outer garment. In some embodiments, the straps are designed with a small rubberized or otherwise textured top area 150 to hold her bra or camisole straps (not shown) in place. A small area under the strap 140 is rubberized 150 or otherwise textured at the shoulder to set the strap into position and hold strap in place.

In some embodiments, there is a low-cut upper front 175 and 275 that is more firmly knitted to just below the breast and under the arms on the sides, as shown in FIGS. 1 and 2. The shoulder straps trim the upper area of the low-cut scoop, becoming a shelf bra or a textured area that can be easily tucked under the lower seam of a separate bra. The band is a gently woven yet supportive band that is wider than the shoulder strap. This multi-purpose design allows the shelf bra to fit comfortably into a bra, or to support the breasts when a bra is not worn. The design and compression level in this area of the garment prevents the garment from cutting into the ribs and allows a gapless transition between a bra (if wearer opts) and the garment for a smooth foundation.

In some embodiments, as shown in FIG. 3, there is a high-cut upper back 300 that transitions upward from the firmly knitted lower back 310, to a gently woven yet supportive band at the top 320. This design prevents back skin from being pinched while providing a firm foundation for a bra back (if wearer opts) minimizing the appearance of lines if worn with a bra.

Figure 7:
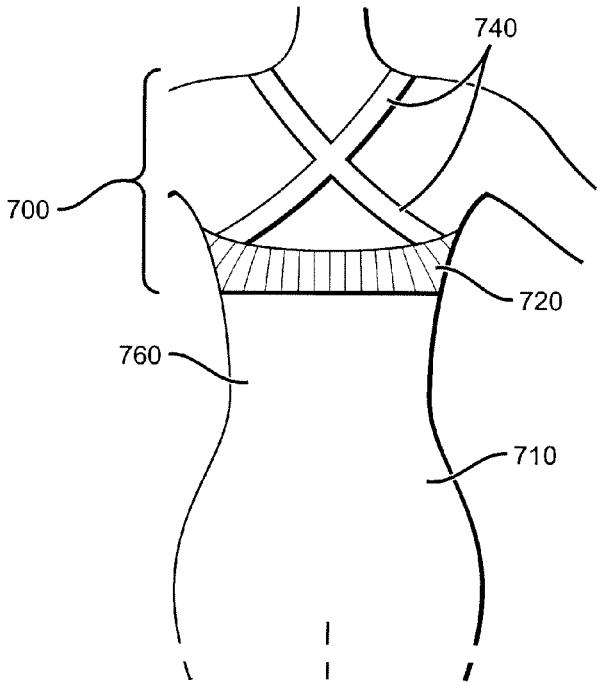
FIG. 7 shows a contemplated embodiment.

In another embodiment, shown in FIG. 4, the shapewear garment comprises a high-cut halter back 400 where the compression transitions upward from the firmly knitted lower back 410 to a gently woven, yet supportive, band 420 at mid-back, while the shelf bra's rubberized band 430 wraps around the base of the neck leaving the bare back 450 open. In a related embodiment, as shown in FIG. 5, a low-cut halter back 500 is contemplated that comprises a supportive band 520 just above the waist, while the shelf bra's rubberized band 530 wraps around the base of the neck leaving the bare back 550 open. In yet another contemplated embodiment, as shown in FIG. 6, a racer back 600 is built into the back of the shapewear garment 610, whereby the firmly knit panel 625 between the racer back edges 640 adds support while holding edges in place. A cross-back design 700 is also contemplated, which is shown in FIG. 7, wherein the cross-back design 700 is built into the shapewear garment 710. A supportive band 720 is placed just above the waist 760, while cross-straps 740 extend from the shelf bra (not shown) to the back supportive band 720.

Contemplated body garments are made of the same sheer, silky smooth and comfortable blend of nylon, SPANDEX® threads or combinations thereof found in any top-quality support pantyhose, support garments and other SPANDEX® support garments. LYCRA® and other similar fabrics may also be included in the one-piece foundation in order to provide additional properties to the shapewear garment. It is this sheer fabric and circular knit construction that allows the body garment to be worn under most any garment and most any fabric. It is designed to tone, lift, and support both front and back from the upper torso under the arms all the way to below the knees, ankles, or toes.

Figure 9:
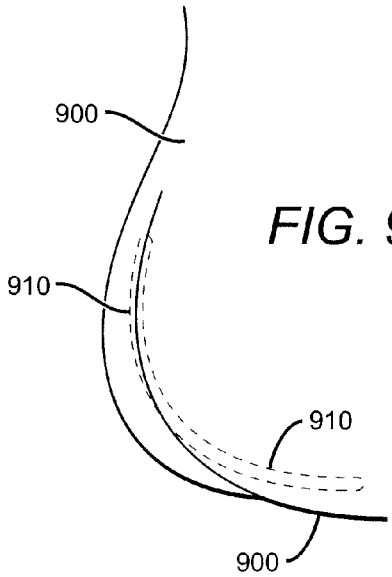
FIG. 9 shows a contemplated embodiment.
Figure 8:
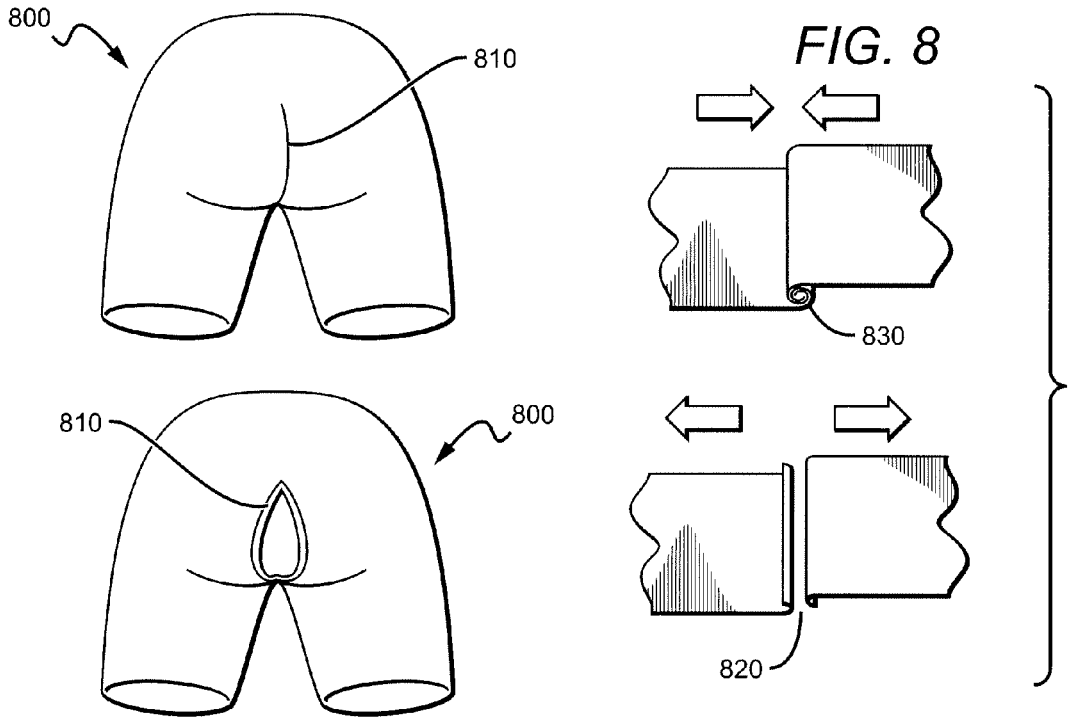
FIG. 8 shows a contemplated embodiment.

Contemplated shapewear garments comprise a firmly woven upper leg that lifts and supports lower buttocks and transitions to a more gently woven fit over the derriere. As shown in FIG. 8, a unique two-piece rolled thong-like seam 810 design is built into the shapewear garment 800 that provides rounded, natural looking posterior curvatures from all angles and does away with a flattened unnatural appearance. The two-piece rolled resealable thong-like seam 810 is designed to be rolled open 820 and closed 830 (resealable). Most importantly, unlike the vented gusset design of other shapewear, this design separates widely and closes tightly at the seam to prevent soiling of the garment when going to the bathroom. FIG. 9 shows how a contemplated two-piece rolled resealable thong-like seam 910 is incorporated into a one-piece foundation of the shapewear garment 900 and how the shapewear garment 900, including the two-piece rolled resealable thong-like seam 910 are worn on a body. The dotted lines are used to show how the seam fits into the crevice of a body in a thong-like manner. The two-piece elasticized thong-like seam is designed to fit the body the same way.

Figure 10:
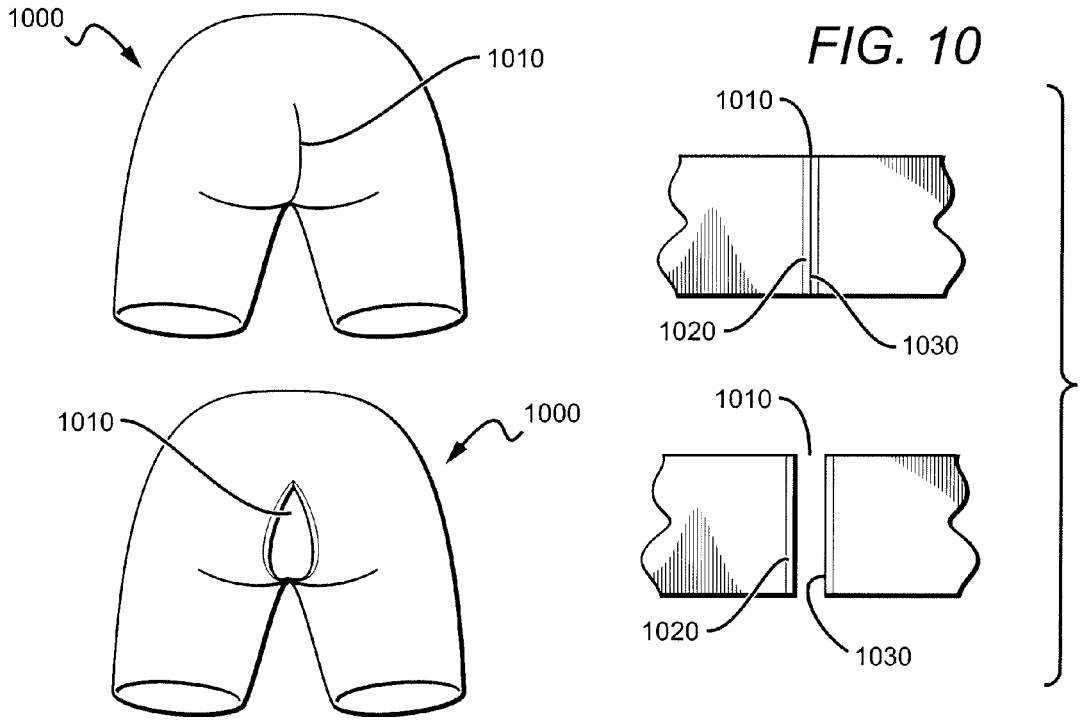
FIG. 10 shows a contemplated embodiment.

In another embodiment, as shown in FIG. 10, an elasticized resealable thong-like split seam 1010 is shown as part of the one-piece foundation of a shapewear garment 1000 where a thin section 1020 of innermost seam edges 1030 are gently elasticized, which allows a comfortable yet gentle thong-like fit for full coverage design without flattening natural curves. This embodiment is designed to separate widely and close tightly at the seam (resealable). In these embodiments, a contemplated thong-like seam design fits comfortably in crevice providing rounded, natural looking posterior curvatures from all angles and does away with a flattened unnatural appearance. In these embodiments the seam design gives a closed seam appearance thus its ability to open is (visually) barely discernible. In some embodiments, the double rolled thong-like seam and/or the elasticized split thong-like seam could be incorporated into full coverage panties in lieu of the traditional strap-type thong. It should be understood that these types of seams are novel in clothing and can be utilized regardless of the type of garment contemplated.

Some additional embodiments include a "just-below-the-knee", "ankle-length", and full length, toeless designs, which have a strap or loop between the big toe and the second toe (similar to a flip-flop shoe) allowing the shapewear garment to be securely held in place.

All styles transition to a gentle yet supportive weave and have a thin, wide band to prevent cutting into leg or foot at the hem, and are finished at the hem with a rubberized, or otherwise textured, under layer to hold them in place.

Although contemplated body garments may comprise any suitable color in opaque material, opaque weave, sheer material, sheer weave or combinations thereof, depending on the needs of the wearer, in some embodiments, body garments may comprise a black, nude, natural tan, brown color or combinations thereof.

Some additional features of contemplated body garments include versions of the following: a scooped-back embodiment (for low-backed clothing); a long-sleeved or half sleeve embodiment; an embodiment where the one-piece foundation comprises lace, such that it is lace-trimmed, full stretch-lace or combinations thereof; embodiments wherein the one-piece foundation comprises logos, tattoos, textures, designs or combinations thereof where they are secured on to, woven in to (or a combination thereof) the one-piece foundation. Contemplated logos, tattoos, textures and designs may be located anywhere on the one-piece foundation including the lower back or ankle. Other embodiments may comprise at least one rubberized, or otherwise textured, exterior waist band, including combinations thereof.

In other embodiments, a plurality of strap adjusters is located on the front of the straps of the shapewear garment that allow the straps to be lengthened or shortened. It is understood that a contemplated shapewear garment comprises a front side and a back side. These at least one strap adjusters are located toward the front side of the shapewear garment. This placement of strap adjusters is something that is not now recognized in the bra, slip or adjustable garment business; and therefore, it is a novel approach to strap management. In addition, by locating the strap adjusters in the front of the garment—the adjustment tabs are not able to be seen through the outside garment.

Thus, specific embodiments and applications of a body garment and shapewear, its method of production and uses thereof have been disclosed. It should be apparent, however, to those skilled in the art that many more modifications besides those already described are possible without departing from the inventive concepts herein. The inventive subject matter, therefore, is not to be restricted except in the spirit of the disclosure herein. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

I claim:

1. A shapewear garment, comprising:

a one-piece foundation garment designed to cover at least part of the upper torso, the lower torso and the legs, wherein the foundation comprises a compression material having at least one area of firm support and at least one area of light support, and at least one sealable and resealable split double-rolled seam or an elasticized split seam that is positioned in the crevice of the buttocks and the crotch area of a person wearing the shapewear garment.

2. The shapewear garment of claim 1, wherein the compression material comprises a transitional weave.

3. The shapewear garment of claim 1, wherein the compression material comprises a circular knit.

4. The shapewear garment of claim 1, wherein the one-piece foundation garment further comprises any one of a high-cut upper back design, a high-cut halter back design, a low-cut halter back design, a racer back design or a cross-back design.

5. The shapewear garment of claim 1, wherein the one-piece foundation garment comprises any one of a below the knee length design, an ankle length design or a full length toeless design having a toe strap.

6. The shapewear garment of claim 1, wherein the one-piece foundation garment comprises any one of nylon, synthetic fibers, natural fibers or a combination thereof.

7. The shapewear garment of claim 1, wherein the one-piece foundation garment material comprises any one of a black color, a nude color, a natural tan color, a brown color or a combination thereof.

8. The shapewear garment of claim 1, wherein the one-piece foundation garment comprises any one of a sheer material, a sheer weave, an opaque material, an opaque weave or a combination thereof.

9. The shapewear garment of claim 1, wherein the one-piece foundation garment comprises lace.

10. The shapewear garment of claim 9, wherein the one-piece foundation garment is any one of lace-trimmed, full stretch-lace or a combination thereof.

11. The shapewear garment of claim 1, further comprising at least one shoulder strap coupled to the one-piece foundation garment.

12. The shapewear garment of claim 11, wherein the shapewear garment comprises a front side intended to be located on the front of a wearer and a back side intended to be located on the back of a wearer, and the at least one shoulder strap comprises at least one strap adjuster located toward the front side of the shapewear garment.

13. The shapewear garment of claim 1, wherein the one-piece foundation garment comprises a shelf bra.

14. The shapewear garment of claim 1, wherein the one-piece foundation garment comprises at least one textured or rubberized area as part of the garment.

15. The shapewear garment of claim 1, wherein the one-piece foundation garment comprises either half sleeves or long sleeves.

16. The shapewear garment of claim 1, wherein the one-piece foundation garment comprises any one of logos, textures, designs or combinations thereof.

17. The shapewear garment of claim 16, wherein the logos, textures, designs or combinations thereof are secured, printed or embossed on to the one-piece foundation garment.

18. The shapewear garment of claim 16, wherein the logos, textures, designs or combinations thereof are woven in to the one-piece foundation garment.

* * * * *